US009746299B1

(12) United States Patent
Davis

(10) Patent No.: US 9,746,299 B1
(45) Date of Patent: Aug. 29, 2017

(54) MAGNETIC POCKET CLIP FOR HOLDING FIREARM AMMUNITION MAGAZINES

(71) Applicant: Graig Michael Davis, Barberton, OH (US)

(72) Inventor: Graig Michael Davis, Barberton, OH (US)

( * ) Notice: Subject to any disclaimer, the term of this patent is extended or adjusted under 35 U.S.C. 154(b) by 0 days.

(21) Appl. No.: 15/530,168

(22) Filed: Dec. 8, 2016

(51) Int. Cl.
*F42B 39/02* (2006.01)
*A45F 5/02* (2006.01)

(52) U.S. Cl.
CPC ..... *F42B 39/02* (2013.01); *A45F 5/022* (2013.01)

(58) Field of Classification Search
CPC ..... F42B 39/02; F42B 39/08; F42B 39/082; F42B 39/085; A45F 5/022; A45F 5/021
See application file for complete search history.

(56) References Cited

U.S. PATENT DOCUMENTS 2,910,804 A * 11/1959 White ..... F41C 33/0263 2/300
4,120,109 A * 10/1978 Musgrave ..... F41A 9/64 42/90
4,580,363 A 4/1986 Rowe, Jr. ..... 42/18
4,597,213 A 7/1986 Musgrave ..... 42/90
6,264,079 B1 * 7/2001 Skaggs ..... F41C 33/0236 224/193
6,763,984 B2 * 7/2004 Gallagher ..... A45F 5/02 224/193
7,025,238 B2 * 4/2006 Hughes ..... A45F 5/00 206/3
7,614,534 B2 * 11/2009 Veo ..... F42B 39/02 224/196
8,231,098 B2 7/2012 Felts ..... 224/665
8,727,294 B1 * 5/2014 Harms ..... F41A 23/18 206/317
8,733,606 B2 5/2014 Felts ..... 224/671
9,072,361 B1 7/2015 Aravena ..... 2/300
9,170,064 B2 10/2015 Rogers ..... 224/230
9,182,205 B2 11/2015 Sitz ..... 229/255
D749,843 S 2/2016 Faifer ..... D3/262
D762,076 S 7/2016 Adam et al. ..... D6/552
2010/0176173 A1 * 7/2010 Felts ..... A45F 5/02 224/665
2010/0176174 A1 7/2010 Felts ..... 224/666
2012/0255979 A1 * 10/2012 Sitz ..... F41C 33/0245 224/243
2013/0248566 A1 * 9/2013 Solomon ..... A45F 5/02 224/191
2013/0254976 A1 10/2013 Aravena ..... 2/300
(Continued)

*Primary Examiner* — Corey Skurdal
(74) *Attorney, Agent, or Firm* — David A. Burge

(57) ABSTRACT

A holder for receiving and releasably retaining ferrous metal ammunition magazines for firearms in a pocket of a garment includes a rare earth magnet positioned in a passage formed centrally through a ferrous metal plate, with the passage having a front end region that is sized to retain the magnet within the passage. A rear opening of the passage is closed by a flat central region of a C-shaped ferrous metal retaining member that has spaced, forwardly extending right and left arms for retaining an ammunition magazine therebetween and in contact with a front surface of the metal plate. An elongate reverse-bent metal clip positioned rearwardly of the retaining member is configured to grip garment pocket material to secure the holder where desired.

20 Claims, 4 Drawing Sheets

(56) References Cited

U.S. PATENT DOCUMENTS

| | | | | |
|---|---|---|---|---|
| 2013/0270311 | A1* | 10/2013 | Sitz | F41A 23/18 224/255 |
| 2014/0103083 | A1* | 4/2014 | Sitz | F42B 39/08 224/255 |
| 2014/0109455 | A1* | 4/2014 | Chiang | F42B 39/02 42/90 |
| 2014/0252053 | A1 | 9/2014 | Rogers | 224/230 |
| 2015/0260479 | A1 | 9/2015 | Aravena | 2/300 |

* cited by examiner

MAGNETIC POCKET CLIP FOR HOLDING FIREARM AMMUNITION MAGAZINES

REFERENCE TO PROVISIONAL APPLICATION

This application claims the benefit of U.S. Provisional Application Ser. No. 62/266,390 entitled MAGNETIC POCKET CLIP TO HOLD FIREARM MAGAZINE filed Dec. 11, 2015 by GRAIG MICHAEL DAVIS, the disclosure of which is incorporated herein by reference.

CROSS-REFERENCE TO RELATED APPLICATIONS

This application also is a Continuation-In-Part of each of two pending Design Applications, namely:

1) Ser. No. 29/620,284 filed Sep. 15, 2016 by Graig Davis entitled Pants Pocket Magnetic Retainer For Ammunition Magazines; and, 2) Ser. No. 29/620,283 filed Sep. 15, 2016 by Graig Davis entitled Pants Pocket Magnetic Retainer For Ammunition Magazines.

The disclosures of all of the aforementioned applications are incorporated herein by reference.

BACKGROUND

Many of the people who carry concealed firearms also desire to carry one or more "backup magazines" each containing an auxiliary supply of ammunition.

To ensure that ammunition-containing backup magazines are readily accessible without being readily noticeable, those who carry concealed firearms often desire to carry their backup magazines in an easily accessed pocket of a garment—typically a front pants pocket.

Designing a holder for carrying a backup ammunition magazine in a front pants pocket needs to take into account the fact that a magazine loaded with ammunition is relatively heavy, often tends to move about, and quickly can become lodged in a less than comfortable pocket location where the magazine may not be easy to access.

Some designers of ammunition magazine holders have Laken the approach of providing plastic materials together with padding and/or soft leather to surround each backup magazine—but this often has tended to increase the size and bulbous nature of the holders, rendering them less suitable and more clumsy to be carried in a front pants pocket or the like.

Some designers of ammunition magazine holders have taken the approach of utilizing thin, relatively lightweight metal such as aluminum to define a retaining compartment for a backup magazine—but this approach has often has led to the provision of holders that are easily crushed or otherwise deformed, many of which have been cheaply and inappropriately constructed. The resulting holders have often been constructed from inexpensive materials that are not well suited to providing a lengthy life of good and reliable service.

Although some designers of magazine holders have attempted to provide a clip or other means for attaching one or more portions of a magazine holder to one or more selected portions of a garment, the clips or other forms of retainers that have been proposed or provided have not proven to be well suited to the task of retaining ammunition magazines at particular desired locations within a garment pocket.

SUMMARY OF THE INVENTION

In a preferred embodiment, the present invention provides a minimalist type of back-up magazine holder capable of being inconspicuously clipped inside a garment pocket, such as a front pants pocket or the like.

Magazine holders embodying the preferred practice of the present invention are ruggedly constructed, and include a small set of ferrous metal components that cooperate with a remarkably strong rare earth magnet that securely releasably retains ammunition magazines between a pair of parallel-extending arms of a C-shaped retaining member that can be quickly and easily interchanged with other sizes of C-shaped retaining members, thereby permitting magazine holders that embody the present invention to receive and releasably retain any of more than a hundred sizes and configurations of commonly used ammunition magazines for firearms.

A feature of ammunition magazine holders that embody the preferred practice of the present invention is that, with the removal of only two conveniently located screws, the C-shaped retaining member of each magazine holder can be quickly and easily interchanged with two or more other sizes of C-shaped retaining members, each of which is capable of retaining and restraining 30 or more sizes and configurations of commonly used backup ammunition magazines.

By purchasing a kit containing one assembled magazine holder together with two alternate sizes of C-shaped retaining members, a person who has even a large collection of concealed carry firearms can use his or her magazine holder to carry nearly all of the many commonly used sizes and shapes of backup ammunition magazines.

A further feature of ammunition magazine holders that embody the preferred practice of the present invention is that each of the holders includes a strong and well-designed pocket clip that is capable of clampingly engaging a flap of garment material such as covers the exterior of a pants pocket, to securely retain and hold an ammunition magazine in a selected position, thereby permitting a backup magazine to be quickly, easily and reliably accessed when it is wanted or needed.

Although the strong rare earth neodymium magnet that resides at the heart of magazine holders embodying the present invention is commercially available, it is understood to represent the most advanced commercialized permanent magnet material available today. Its strength and reliability provide magazine holders that embody the preferred practice of the present invention with product features of unequaled reliability.

DESCRIPTION OF THE DRAWINGS

A fuller understanding of the invention may be had by referring to the following description, taken in conjunction with the accompanying drawings, wherein.

DETAILED DESCRIPTION

Figure 1:
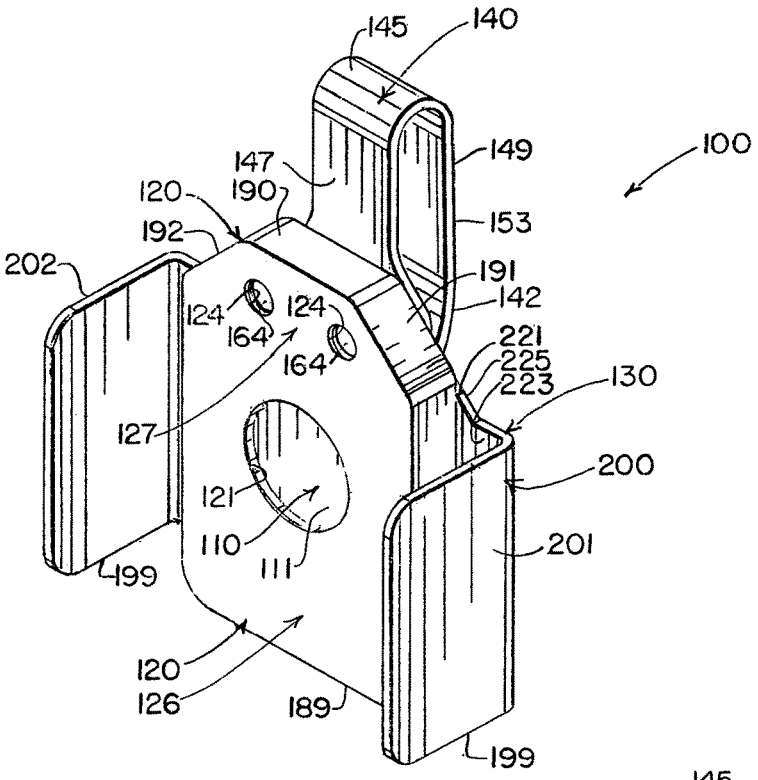
FIG. 1 is a perspective view showing principally front, top and right side features of a preferred practice of the present invention.

Shown in FIG. 1 are front, top and right side features of a magnetic pocket clip ammunition magazine holder 100 embodying a preferred practice of the present invention, that is designed to receive, one at a time, a wide variety of sizes and configurations of such ammunition magazines as are in current day use by, for and with firearms such as handguns, and even some long guns such as rifles (not shown).

Figure 2:
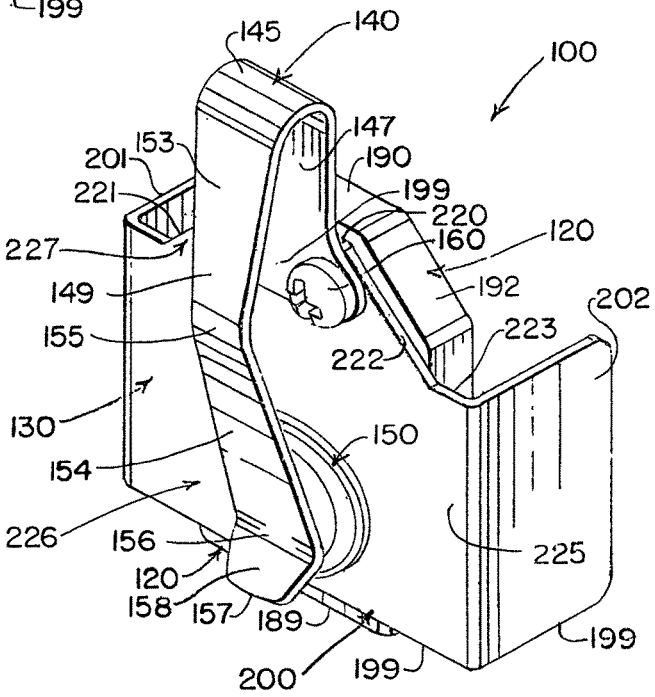
FIG. 2 is an alternate perspective view showing principally rear, top and left side features thereof.
Figure 3:
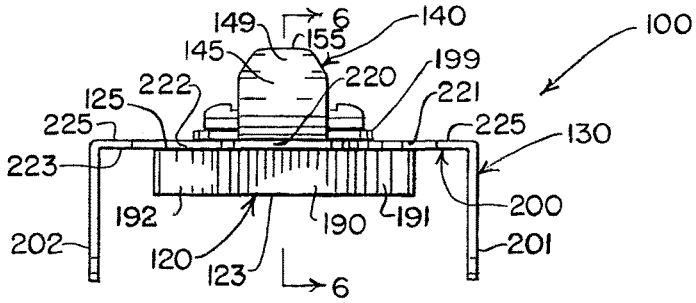
FIG. 3 is a top view thereof.
Figure 4:
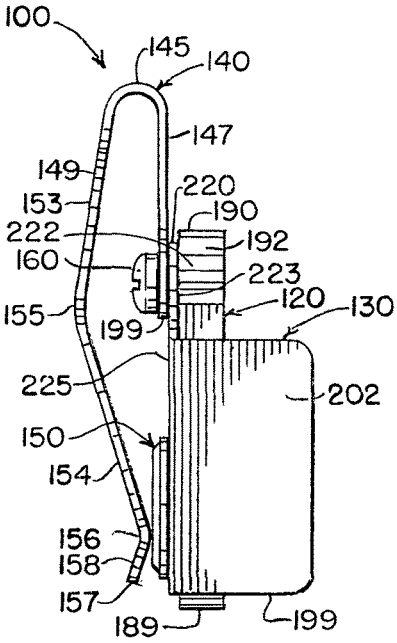
FIG. 4 is a left side view thereof.
Figure 5:
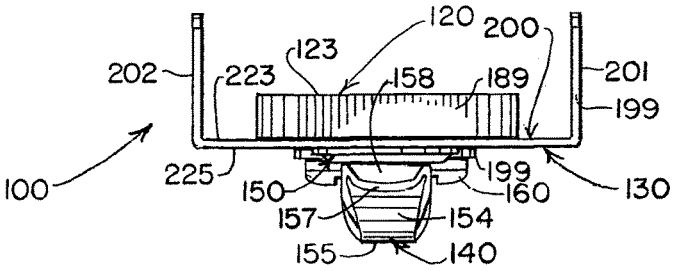
FIG. 5 is a bottom view thereof.

Shown in FIG. 2 are rear, top and left side features of the same ammunition magazine holder 100; and, shown in FIGS. 3, 4 and 5 are top, left and bottom views of the magazine holder 100.

Figure 7:
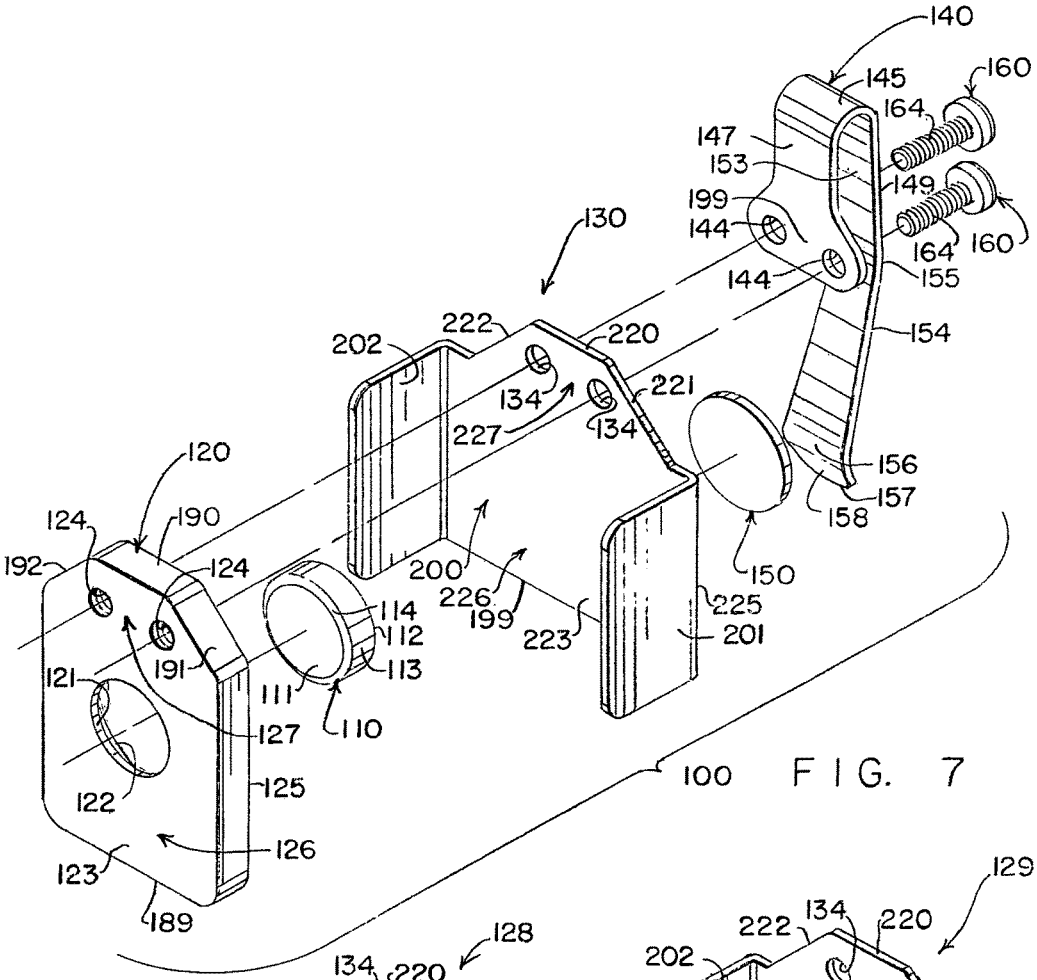
FIG. 7 is an exploded view thereof.

Shown in the exploded view provided by FIG. 7 are the components of the magazine holder 100. The components shown in FIG. 7 include a disc-shaped rare earth magnet 110, a relatively thick ferrous metal plate 120, a C-shaped ferrous metal retaining member 130, a pocket clip 140, and a disc-shaped resilient rubber pad 150.

A pair of conventional, commercially available threaded fasteners, namely two torx-head screws 160, have threaded stem portions 164 for being tightened into threaded holes 124 formed through the metal plate 120 after passing through holes 134 and 144 that are formed through the retaining member 130 and the pocket clip 140, respectively.

Figure 6:
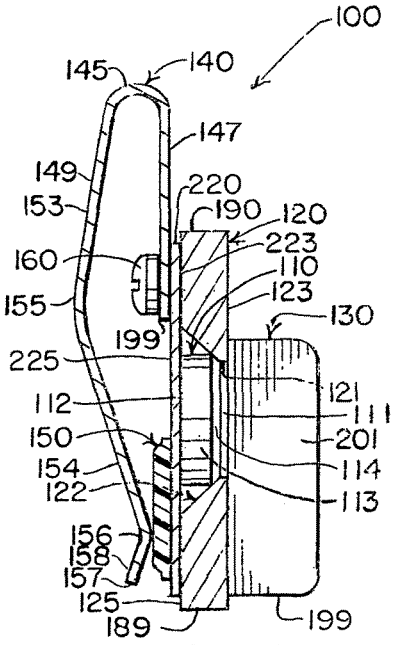
FIG. 6 is a cross-sectional view thereof, as seen from a plane indicated by a line 6-6 in FIG. 3.

Referring to FIG. 6 in conjunction with FIG. 7, the disc-shaped rare earth magnet 110 has opposed front and rear surfaces surfaces 111, 112, respectively, and a round side surface 113. A forty-five degree bevel 114 preferably provides a transition between the front surface 111 and the round side surface 113.

The disc-shaped rare earth magnet 110 is preferably of a commercially available type of magnet such as can be purchased from Monroe Engineering LLC of Rochester Hills, Mich. (with a website at www.monroeengineering-.com). Neodymium Iron Boron (NdFeB) and Samarium Cobalt (SmCo) rare earth magnets are alloys of the Lanthanide group of elements. Such rare earth magnets are understood to be made from the most advanced commercialized permanent magnet materials that are in existence today, and are available in a number of different grades that span a wide range of properties and application requirements, as is explained at Monroe Engineering's website.

The ammunition magazine holder 100 of the present invention is primarily intended to be provided in any of three sizes that will, for purposes of convenience, be referred to as "large," "medium" and "small"—but can, of course, be provided in other sizes than are shown in the accompanying drawings or are explained in the text of this document. What differentiates the so-called "size" of various forms of the ammunition magazine holder 100 is the inside dimension of a C-shaped retaining component of the ammunition magazine holder 100.

Figure 8:
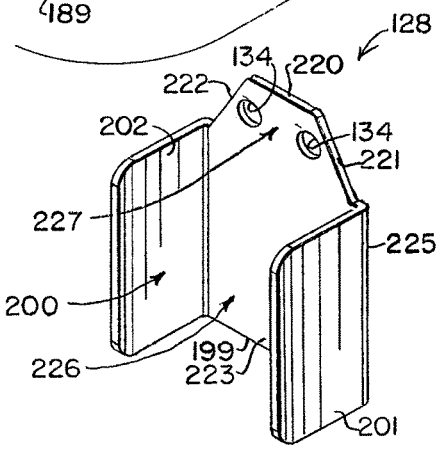
FIG. 8 is a perspective view showing a relatively small retaining member that can be substituted for a relatively large retaining member that is depicted in the exploded view of FIG. 7, and in FIGS. 1-6.
Figure 9:
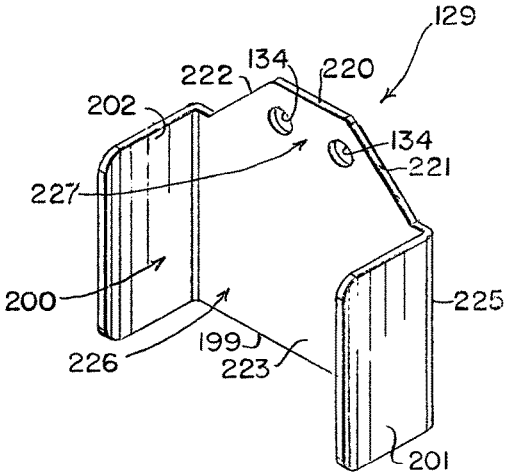
FIG. 9 is a perspective view showing a relatively medium sized retaining member than can be substituted for any of the retaining members that are shown in FIGS. 1-8; exploded view of FIG. 7.

Shown in FIGS. 1-5, and in the exploded view of FIG. 7, is a magnetic pocket clip holder 100 that is provided with the largest of three presently available sizes of C-shaped retaining members 130. Shown in FIG. 8 is the smallest of three presently available sizes of C-shaped retaining members 128. Shown in FIG. 9 is an in-between or medium sized C-shaped retaining member 129. The C-shaped retaining members 128, 129 and 130 are interchangeable, in that any one of the C-shaped retaining members 128, 129 and 130 can be substituted for another of the C-shaped retaining members 128, 129 and 130 to thereby provide magazine holders 100 of small, medium and large sizes, respectively.

The small sized retaining member 128 (as shown in FIG. 8) preferably has a spacing between its right and left arms 201, 202, respectively, of 1.125 inches. The medium sized retaining member 129 (shown in FIG. 9) preferably has a spacing between its right and left arms 201, 202, respectively, of 1.313 inches. The largest size retaining member 130 (shown in FIGS. 1-7) preferably has a spacing between its right and left arms 201, 202, respectively, of 1.438 inches.

The right and left arms 201, 202, respectively, are preferably identically configured on all of the retaining members 128, 129, 130, and preferably extend forwardly from the front surface 223 of the central region 200 approximately one-half inch, and measure about one inch in height—which ensures that the arms 201, 202 do not interfere with portions of ammunition magazines being held in secure contact with the front surface 123 of the metal plate 120 (which is installed just forwardly of the central region 200 of the retaining members 128, 129, 130) by the attraction of the rare earth magnet 110 of the holder assemblies 100.

As will be readily understood by those who are skilled in the art, ammunition magazine holders that embody the present invention are assemblies that can easily be taken apart and reassembled not only 1) because each assembled holder 100 is held together by two easily removed threaded fasteners, namely the screws 160, but also 2) because each assembly 100 consists principally of the ferrous metal components 120, 130 (or 128, 129+130) that also tend to be held together by the attraction of the associated disc-shaped rare earth magnet 110.

As will be explained, releasing and replacing any one of the C-shaped retaining members 128, 129, 130 from one of the holder assemblies 100 requires nothing more than loosening and removing the two threaded fasteners 160, and replacing one of the retaining members 128, 129 and 130 with a different one of the retaining members 128, 129 and 130, whereafter the two removed threaded fasteners 160 are reinstalled to extend through aligned sets of holes 134, 144 formed through the assembled components 130 and 140, respectively, with the replaced screws 160 then being tightened into the threaded holes 124 that extend through the metal plate 120.

Reassembly of the magazine holder 100 with a differently selected C-shaped retaining member 128, 129 or 130 is facilitated by virtue of the strong rare earth magnet 110 which helps to hold the components of the magazine holder assembly 100 in place while the threaded fasteners 160 are being positioned to extend through aligned holes formed through components 120, 130 and 140 of the holder assembly 100.

Each of the three sizes of retaining members 128, 129, 130 is capable of retaining and restraining more than 30 different sizes and configurations of ammunition magazines—such as are shown in various patents, such as Design Pats. D-614,721 and D-593,633 which depict generally straight ammunition magazines, and such as Design Pats. D-727,456 and D-593,635 which depict gently curved ammunition magazines. The disclosures of said design patents are incorporated herein by reference.

The metal plate 120 is preferably formed from ten gauge steel, and is therefore thicker than are the retaining members 128, 129 and 130, all of which are preferably formed from twenty gauge steel. Although the metal clip 140 can be formed from spring steel or the like (that typically has approximately the same thickness as the retaining members 128, 129 and 130), the metal clip 140 is preferably formed from 0.40 inch thick titanium which can retain its integrity and its biasing action to provide a reliably lengthy service life.

As can be seen in FIG. 7, a relatively large diameter passage 122 has an opening 121 through a front surface 123 of the metal plate 120. As can be seen in the cross-sectional view of FIG. 6, the passage 122 has a frustoconical configuration that widens as the passage 122 extends rearwardly from its relatively small diameter opening 121 through the front surface 123 to where the passage 122 opens through a rear surface 125 of the metal plate 120.

The cross-sectional view of FIG. 6 shows how the bevel 114 of the disc-shaped magnet 110 engages the frustoconically tapered passage 122 to position the front surface ill of the disc-shaped magnet 110 at a protected location slightly rearwardly with respect to the front surface 123 of the metal plate 120.

In this document, such words as "front," "rear," "forwardly," "rearwardly," "top," "bottom," "upper," "lower," "upwardly," "downwardly," "left," "right," "leftwardly," and "rightwardly" and "vertically" are used simply for purposes of convenience, and are not to be considered to be limiting.

Referring still to FIG. 7, in addition to the opposed front and rear surfaces 123 and 125, respectively, the metal plate 120 has what will be referred to as a lower end region 126 and an upper end region 127, as well as a bottom edge surface 189 and a top edge surface 190. The upper end region 127 is bordered by not only the top edge surface 190, but also by right and left inclined surfaces indicated by the numerals 191 and 192, respectively.

The retaining member 130 shown in FIG. 7 and the retaining members 128, 129 shown in FIGS. 8 and 9, respectively, all have features that are designated by common reference numerals, including the relatively wide central region 200 that is connected by right-angle bends to the right arm 201 and the left arm 202, respectively, both of which arms extend forwardly from a front surface 223 of the central region 200.

The central region 200 of each of the retaining members 128, 129, 130 has opposed front and rear surfaces 223, 225, respectively (see FIGS. 3 and 5), as well as a lower end region 226 and an upper end region 227, and bottom edge surface 199 and a top edge surfaces 220 that join with inclined right and left surfaces 221, 222, respectively.

In preferred practice, the right and left arms 201, 202 of each of the retaining members 128, 129, 130 preferably extend forwardly from the central region 200 of each of the retaining members 128, 129, 130 a distance of 0.536 inches, and have a height of 1.0 inch. By sizing the left and right arms 201, 202 as has just been explained, the arms 201, 202 are found to not obstruct portions of such ammunition magazines (not shown) as can normally be accommodated by the retaining members 128, 129, 130.

Because some ammunition magazines (not shown) may need longer right and left arms 201, 202 to assist in retaining these ammunition magazines in place between the right and left arms 201, 202 of the retaining members 128, 129, 130, serious consideration is being given to providing retaining members 128, 129, 130 that have longer left and right arms 201, 202.

Referring again to FIG. 7, the metal clip 140 is of elongate configuration, and has an inverted U-shape bend 145 at its upper end, from which a relatively short front leg 147 and a relatively long rear leg 149 depend. The short front leg 147 has an enlarged formation 199 at its lower end region, through which the holes 144 extend. The long rear leg 149 narrows as it depends along an upper reach 153 of the rear leg 149 to where a gentle bend 155 is provided mid-way down the length of the long rear leg. From the region of the gentle bend 155, a lower reach 154 of the long rear leg 149 extends to where another gentle bend 156 is provided near a rounded lower end region 157 of the long rear leg 149. The lower reach 154 biases the bend 156 toward the rear surface 225 of the central region of the retaining member 130, where the disc-shaped resilient rubber pad 150 is adhered to the rear surface 225 of the central region 200 of the retaining member 130.

Figure 11:
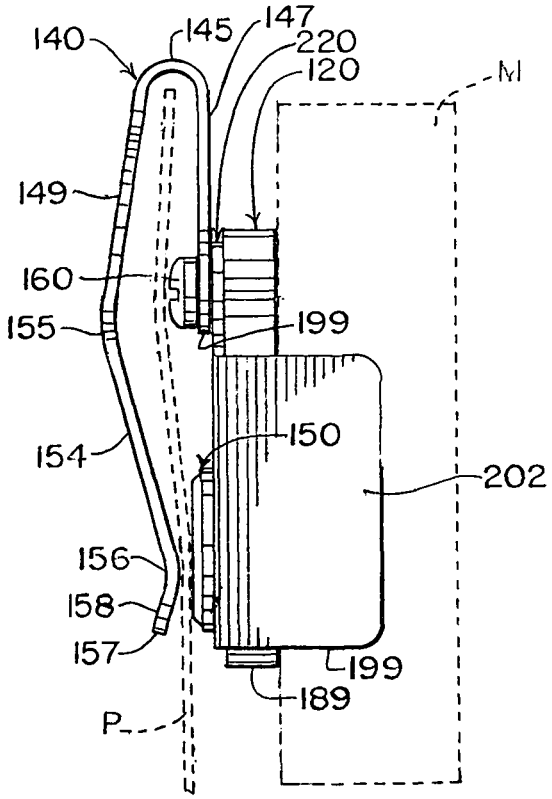

When the metal clip 140 is to receive a flap of pocket material (labeled "P" in FIG. 11) to clamp the pocket material P against the resilient rubber pad 150, the area of the gentle bend can be moved rearwardly away from the resilient rubber pad 150 for as long as is needed to permit the pocket material P to be installed between the rear leg 149 and the rear surface 225 of the central region 200 of the retaining member 130.

Figure 10:
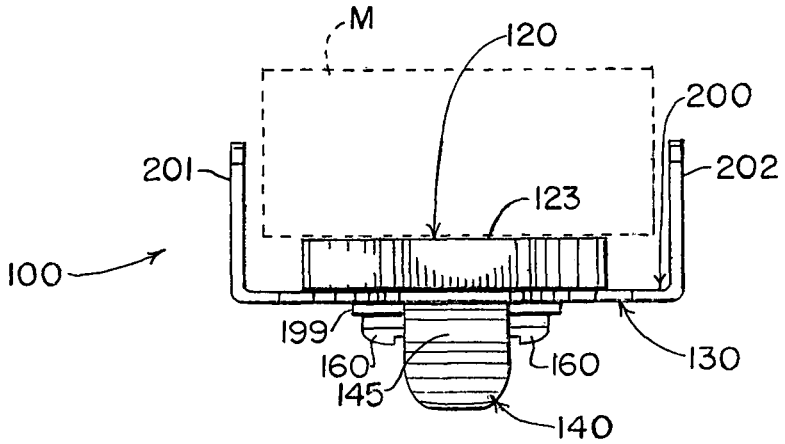
FIG. 10 is a top view much like FIG. 3, with a dotted rectangle labeled "M" added thereto to indicate generally where an ammunition magazine is received and releasably retained by the holder of the present invention; and, FIG. 11 is a left side view much like FIG. 4, with a dotted rectangle labeled "M" added thereto to indicate generally where an ammunition magazine can be positioned in a pocket of one's trousers, with "G" indicating where a flap or reach of garment pocket material can be received between the legs of a metal clip component of a holder embodying the present invention.

When being used, ammunition magazines (such as are designated schematically in FIGS. 10 and 11 by rectangles formed by broken lines and labeled "M") are received between the forwardly-extending arms 201, 202 of a retaining member 130 (or 128, 129) and are held securely by the magnet 110 against a front surface 123 of the metal plate 120. When positioned inside a pocket of a garment, a fabric portion indicated in FIG. 11 by broken lines labeled "P" extends between the front and rear legs 147, 149, respectively, of the metal clip 140, and is clamped between the rear leg 149 and the rear surface 225 of the central region 200 of the receiving member 130 by the biasing action of the metal clip 140.

Although the invention has been described in its preferred form with a certain degree of particularity, it is understood that the present disclosure of the preferred form has been made only by way of example, and that numerous changes in the details of construction and the manner of manufacture and assembly may be resorted to without departing from the spirit and scope of the invention.

It is intended to protect whatever features of patentable novelty exist in the invention disclosed in the text hereof, in the accompanying drawings, and/or in the referenced provisional and the two referenced design applications, the disclosures of all of which are incorporated herein by reference.

What is claimed is:

1. A pocket clip assembly for retaining an ammunition magazine for a firearm, comprising:

a) a disc-shaped rare earth magnet;

b) a C-shaped ferrous metal retaining member having a flat central region with opposed front and rear surfaces, with left and right portions of the central region being joined by right-angle bends to integrally formed forwardly-extending, right and left arms, respectively;

c) a flat ferrous metal plate having opposed front and rear surfaces, with the metal plate having a thickness greater than that of the metal retaining member, and being positioned between the right and left arms of the retaining member, with the rear surface of the metal plate engaging the front surface of the central region of the retaining member;

d) an elongate metal clip having a U-shaped bend in its upper end region, and having spaced integrally formed front and rear legs that depend in overlying relationship from the U-shaped bend, with the front leg having an enlarged formation near its lower end that engages the rear surface of the retaining member, with the rear leg being longer than the front leg and being biased by the configuration of the metal clip toward, and normally into engagement with the rear surface of the retaining member;

e) with a pair of spaced holes each extending through the enlarged formation of the metal clip, through the central region of the retaining member, and through the metal plate, with the holes formed through the metal plate being threaded so that threaded fasteners can extend through the holes in the enlarged formation of the metal clip and through the retaining member before being tightened into the threaded holes of the metal plate to securely connect the components of the ammunition magazine holder; and f) with a tapered passage formed centrally through the metal plate and sized to protectively receive the disc-shaped rare earth magnet therein, with the magnet being confined in the passage by a relatively small front opening of the tapered passage through the front surface of the metal plate, and by the front surface of the retaining member which closes a rear opening of the tapered passage.

2. The pocket clip assembly of claim 1 wherein the rear surface of the retaining member carries a resilient pad into engagement with which the rear leg of the metal clip is normally biased, with a lower end region of the rear leg of the metal clip including a rounded formation that inclines away from the rear surface of the retaining member that can guide and assist insertion of a flap of pants pocket material between the metal clip and the rear surface of the retaining member.

3. The pocket clip assembly of claim 1 wherein the magnet attracts a ferrous metal ammunition magazine into engagement with a front surface of the metal plate.

4. The pocket clip assembly of claim 1 wherein the left and right arms of the C-shaped retaining member are of identical, generally rectangular configuration.

5. The pocket clip assembly of claim 1 wherein the holes that receive the threaded fasteners extend through overlying upper portions of the retaining member and the metal plate.

6. The pocket clip assembly of claim 1 including at least one alternate C-shaped retaining member that can be substituted for the C-shaped retaining member, with the at least one alternate retaining member being configured substantially identically to the retaining member except that the left and right arms of the at least one alternate retaining member are spaced apart by a different distance than are the left and right arms of the retaining member.

7. The pocket clip assembly of claim 1 wherein the U-shaped bend of the metal clip is spaced above uppermost portions of the retaining member and the metal plate.

8. The pocket clip assembly of claim 1 wherein the downwardly extending rear leg of the metal clip has a width that narrows to where the downwardly extending rear leg has a gentle bend that causes a lowermost portion of the downwardly extending rear leg to incline toward the rear surface of the retaining member.

9. The pocket clip assembly of claim 1 wherein a front surface of the disc-shaped magnet is protectively retained within the tapered passage at a location spaced rearwardly from the front surface of the metal plate.

10. The pocket clip assembly of claim 1 wherein the left and right arms are identically configured.

11. The pocket clip assembly of claim 1 wherein the holes that receive threaded fasteners extend through overlying upper portions of the retaining member and the metal plate.

12. The pocket clip assembly of claim 1 including a secondary C-shaped retaining member that can be substituted for the C-shaped retaining member, with the secondary retaining member being configured substantially identically to the retaining member except that the left and right arms of the secondary retaining member are spaced apart by a different distance than are the left and right arms of the retaining member.

13. The pocket clip assembly of claim 1 wherein the reverse bend of the metal clip is spaced above uppermost portions of the retaining member and the metal plate.

14. The pocket clip assembly of claim 1 wherein the downwardly extending leg of the metal clip has a width that narrows to where the downwardly extending leg has a gentle bend that causes a lowermost portion of the downwardly extending leg to incline toward the rear surface of the retaining member.

15. The pocket clip assembly of claim 1 wherein the tapered hole positions the disc-shaped magnet so that a front surface of the magnet is located slightly rearwardly from the front surface of the metal plate.

16. A pocket clip assembly for magnetically retaining an ammunition magazine for a firearm, comprising:

a) a ferrous metal retaining member of uniform thickness defining a flat central region having opposed front and rear surfaces, and defining a pair of parallel, forwardly-extending arms that are connected by right-angle bends to left and right portions of the central region, with a uniform spacing between the arms being selected to be greater than the widths of all ammunition magazines that are to be positioned between the forwardly-extending arms;

b) a flat, ferrous metal plate having a uniform thickness greater than the thickness of the retaining member, having opposed forwardly-facing and rearwardly-facing surfaces, with the rearwardly-facing surface engaging the front surface of the retaining member, and having a uniform width between opposed parallel-extending edges of the plate that permits the plate to be positioned between the parallel-extending arms of the retaining member;

c) a metal clip having an upwardly extending front leg, and a downwardly extending rear leg connected by a reverse bend that spaces the front and rear legs apart so that a flap of pants pocket material can extend into a space between the front and rear legs, with the front leg having an enlarged formation near its lower end to engage the rear surface of the retaining member, and with the rear leg being longer than the front leg and having a lower end region that is biased toward the rear surface of the retaining member;

d) with a pair of spaced holes formed through the enlarged formation of the metal clip, through the central region of the retaining member, and through the metal plate, with the holes formed through the metal plate and each being threaded so that threaded fasteners can extend through the holes to attach the metal clip, the retaining member and the metal plate; and e) with a frustoconically tapered hole formed centrally through the metal plate to provide a tapered passage within which a disc-shaped magnet is positioned that cannot pass through a relatively small diameter end region of the tapered passage, and with a relatively large diameter end region of the tapered passage being closed by the central region of the retaining member.

17. The pocket clip assembly of claim 16 additionally including an end region of the rear leg of the metal clip defining a rounded formation that can assist the flap of pants pocket material to be inserted between the lower end region of the rear leg and the rear surface of the retaining member.

18. The pocket clip assembly of claim 16 additionally including a resilient pad adhered to the rear surface of the retaining member for being engaged by the lower end region of the rear leg of the metal clip when no flap of pants pocket material extends between the lower end region of the rear leg the rear surface of the retaining member.

19. A magnetic pocket clip assembly for releasably retaining, one at a time, ammunition magazines for firearms, comprising:

a) a generally rectangular ferrous metal plate for extending substantially vertically, with the plate having opposed, overlying front and rear surfaces, with a pair of threaded holes being formed through the metal plate, with each of the threaded holes opening through the front and rear surfaces, and with a tapered passage also being formed trough the metal plate and being configured to prevent a magnet from moving through an opening of the passage through the front surface;

b) at least two C-shaped ferrous metal retaining members that each have a flat central region that extends between left and right forwardly extending arms that are differently spaced thereby permitting each of the metal retaining members to receive ammunition magazines of different dimensions, with the spaces between the left and right arms of each C-shaped retaining members being sufficient to permit the metal plate to be positioned therebetween and to overlie and close an opening of the tapered passage through the rear surface, with each of the central regions of the C-shaped retaining members having two holes formed therethrough that are alignable with the pair of threaded holes formed through the metal plate when the metal plate is positioned between the left and right arms; and, c) a metal garment clip having a front leg that positions a reverse bend of the clip at a location above uppermost portions of the metal plate and either of the C-shaped retaining members when the metal plate is positioned as described between the left and right arms of either of the C-shaped retaining members, with a lower portion of the front leg having an enlarged formation through which holes are formed that can align with the pair of threaded holes formed through the metal plate so the metal plate and the C-shaped retaining members can be assembled one-at-a-time by a pair of screws inserted through the aligned holes and tightened into the threaded holes.

20. The magnetic pocket clip assembly of claim 19 wherein the clip also has a rear leg that depends from the reverse bend and is biased toward a rear surface of either of the C-shaped retaining members.

* * * * *